United States Patent [19]

Miki et al.

[11] Patent Number: 4,583,579

[45] Date of Patent: Apr. 22, 1986

[54] METHOD OF DIE CASTING

[75] Inventors: Isao Miki, Shizuoka; Tsutomu Nagi, Numazu; Haruyasu Kattoh, Shimizu, all of Japan

[73] Assignee: Nippon Light Metal Co., Ltd., Tokyo, Japan

[21] Appl. No.: 632,666

[22] Filed: Jul. 20, 1984

[30] Foreign Application Priority Data

Jul. 25, 1983 [JP] Japan ..... 58-135361

[51] Int. Cl.[4] ..... B22D 17/32

[52] U.S. Cl. ..... 164/457; 164/150; 164/458; 164/113

[58] Field of Search ..... 164/457, 155, 4.1, 150, 164/113, 458

[56] References Cited

U.S. PATENT DOCUMENTS 3,583,467 6/1971 Bennett et al. ..... 164/458
3,931,847 1/1976 Terkelsen ..... 164/458
4,252,174 2/1981 Miki et al. ..... 164/457
4,493,362 1/1985 Moore et al. ..... 164/457

*Primary Examiner*—Nicholas P. Godici
*Assistant Examiner*—Samuel M. Heinrich
*Attorney, Agent, or Firm*—Oblon, Fisher, Spivak, McClelland & Maier

[57] ABSTRACT

A method of die casting using a plunger tip of a reciprocal plunger for forcibly injecting the molten metal supplied to the inner space of a sleeve into the mold cavity through a spool bush connected therebetween. The temperature of at least a portion of at least one of the plunger tip, the sleeve, and the spool bush is measured. Retracting of the plunger is commenced on the basis of the measured temperature after each shot of die casting. The measured temperatures of the plunger tip, the sleeve, and/or the spool bush is utilized for calculating the clearance at the peripheral surface of the plunger tip, and the retracting of the plunger is commenced at the time the clearance is calculated to reach a predetermined set value of clearance.

15 Claims, 5 Drawing Figures

METHOD OF DIE CASTING

BACKGROUND OF THE INVENTION

The present invention relates to a method of die casting by forcibly injecting molten metal into a mold cavity in a metallic mold assembly, and, more particularly, it relates to improvements in the method of die casting wherein a plunger is driven in a sleeve so as to forcibly inject molten metal poured in the sleeve into the mold cavity at a high pressure by means of a plunger tip secured to the tip of the plunger.

In such a method of die casting, the inner surface of the sleeve and the forward end surface of the plunger tip which are subjected to relative shifting movement at each shot of die casting are rendered to be a high temperature. To avoid the temperature rise, the sleeve and the plunger tip are usually provided with a cooling construction such as internal passages, respectively, through which cooling liquid such as water is circulated so as to maintain them at a low temperature. However, due to difference in the heat capacity between the sleeve and the plunger tip, variation in the clearance between the inner surface of the sleeve and the peripheral surface of the plunger tip can not be avoided when the temperature thereof varies. In general, the influence due to expansion of the plunger tip having a relatively little heat capacity is great and the clearance between the plunger tip and the sleeve immediately after each shot of die casting is reduced and, after a time period during which cooling is effected, the clearance is gradually increased and is restored to the initial condition. Such a variation in the clearance naturally takes place repeatedly as the time lapses in each shot in which the molten metal is injected into the mold cavity.

The clearance between the inner surface of the sleeve and the peripheral surface of the plunger tip is an important factor affecting the relative shifting movement therebetween. Particularly, if the plunger tip is retracted under the condition that the clearance is reduced to a value not acceptable for proper die casting, the failure or breakage will take place in the die casting apparatus such as the sleeve and the plunger tip due to the biting of casting fins or flashes between the inner surface of the sleeve and the peripheral surface of the plunger tip.

In order to prevent such a trouble caused by the variation in the clearance between the inner surface of the sleeve and the peripheral surface of the plunger tip, the control of the operation of the plunger has heretofore been effected in general by estimating the value of the clearance according to the lapse of time utilized as a factor for determining the same, and initiating the operation of the plunger on the basis of the estimated clearance. In other words, in order to avoid the biting of the fins or the flashes between the inner surface of the sleeve and the peripheral surface of the plunger tip caused due to too small clearance in each shot cycle wherein the molten metal is forcibly injected into the mold cavity by the forward movement of the plunger, and the plunger is retracted after the solidified die cast product has been taken out of the mold cavity so as to be ready for the succeeding die casting operation, the control of the operation of the plunger has been effected hereinbefore in such a manner that the initiation of retracting of the plunger is delayed until the time period lapses in which it is assumed to be sufficient to restore the required value of clearance.

With such a control of operation based on the time chart of the variation in the clearance, however, an excessive unacceptable clearance or even a condition that the plunger tip is rendered to be press-fitted in the sleeve might take place, should a failure take place in the cooling system or an abnormal condition of the die casting apparatus caused by the fluctuation in the respective shot cycle, even though a sufficient time period be given for insuring the security or safety of the apparatus. That is, the above described control of operation of the plunger effected on the basis of the time chart has a fatal disadvantage in that it can not insure sufficient clearance for achieving security in case of occurrence of an abnormal condition of operation.

In addition to the above, the efficiency in the die casting operation is greatly affected depending upon the set time period of initiating the operation of the plunger after each shot. The higher the security is set, the more the efficiency is deteriorated, thereby resulting in disadvantage rendering the improvement in efficiency in the die casting to be difficult.

Under such circumstances, it has long been desired to make it possible to detect or ascertain positively and efficiently the value of the clearance even though an abnormal condition occurs in the die casting apparatus so as to avoid the failure or breakage of the die casting apparatus.

SUMMARY OF THE INVENTION

The major object of the present invention is, therefore, to provide a method of die casting which avoids the disadvantages of the prior art method described above and which makes it possible to positively and effectively ascertain the clearance between the inner surface of the sleeve and the peripheral surface of the plunger tip in a die casting apparatus so as to appropriately determine the time at which the plunger is to be retracted without causing defective biting of casting fins or flashes in the clearance.

Another object of the present invention is to provide a method of die casting as described above which makes it possible to positively detect the occurrence of an abnormal condition in the die casting operation on the basis of the clearance ascertained as described above.

A further object is to provide a method of die casting as described above wherein the retracting of the plunger tip is withheld until a predetermined set time is reached as measured from commencement of injecting the molten metal. This insures sufficient time for removing the fins or flashes around the plunger tip after each shot. Such being the case, the time for retracting the plunger as determined by the method of the present invention is rendered to be very short.

In accordance with the characteristic feature of the present invention, a method of die casting is provided which includes the step of forcibly injecting molten metal poured in a sleeve into a mold cavity by means a plunger tip of a plunger slidable in the sleeve. The method is characterized by measuring the temperature of at least a portion of at least one of the plunger tip, the sleeve and a spool bush connected between the sleeve and the mold cavity so as to control the time at which the plunger is to be retracted after each shot of die casting on the basis of the temperature thus measured.

In accordance with another characteristic feature of the present invention, the plunger is withheld from retracting operation after a shot if the measured temperature is still held higher than a predetermined set temperature after lapse beyond a set time period, assuming that the measured temperature still held higher than the set temperature after the lapse beyond the set time period indicates that an abnormal condition or failure has taken place in the die casting apparatus.

Alternatively, the plunger may be forcibly retracted after a shot even though the measured temperature is still held higher than the above described predetermined set temperature after lapse beyond the above described set time period, but an alarm is actuated when the set time is reached so as to permit expediting of the repairing operation for the abnormal conditions.

In accordance with a further characteristic feature of the present invention, the plunger is withheld from retracting operation until another predetermined set time is reached as measured from commencement of injecting the molten metal so as to insure sufficient time enabling the removal of the fins or flashes sticking to the plunger tip after a shot, in case the time for retracting the plunger as determined by the method of the present invention is rendered to be too short.

BRIEF DESCRIPTION OF THE DRAWINGS

The present invention will be described below with reference to a preferred embodiment thereof illustrated in the accompanying drawings, in which.

DETAILED DESCRIPTION OF THE PREFERRED EMBODIMENT

Figure 1:
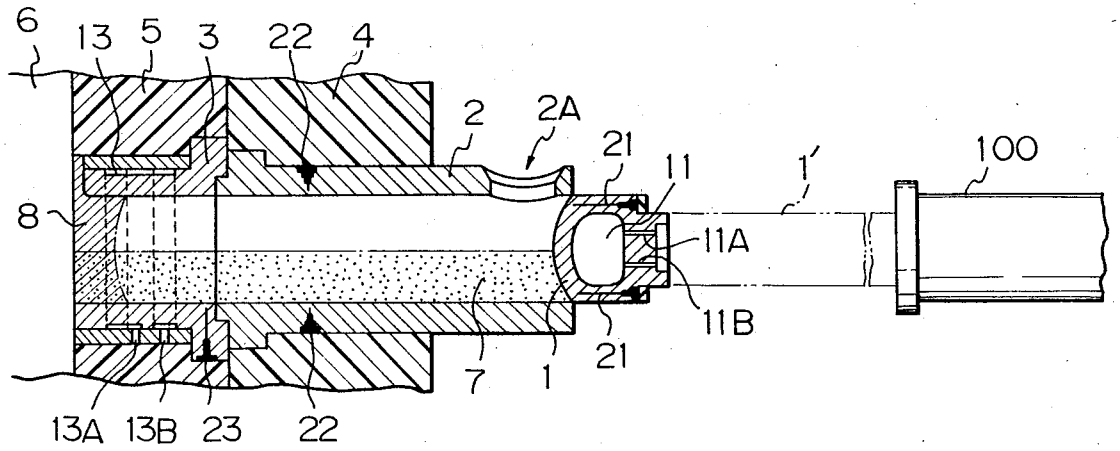
FIG. 1 is a schematic longitudinal sectional view showing an embodiment of the die casting apparatus for carrying out the method of die casting of the present invention.

Referring now to FIG. 1 showing schematically the die casting apparatus for carrying out the present invention, it comprises a plunger tip 1 mounted on the tip of a plunger 1', a sleeve 2 having a molten metal pouring opening 2A and reciprocally slidably receiving therein the plunger 1', a spool bush 3 connected to the forward end of the sleeve 2 in alignment with the sleeve 2, a stationary die plate 4 fixedly mounting therein the sleeve 2, a stationary mold 5 fixedly mounting therein the spool bush 3 and a movable mold 6, a mold cavity 8 being formed in the interior of the stationary mold 5 and the movable mold 6 when they are moved and abut against each other.

The plunger tip 1 is reciprocally driven in the sleeve 2 and the spool bush 3 by pushing means 100 such as a hydraulically actuated cylinder device. When the plunger tip 1 is driven to the left in FIG. 1, the molten metal 7 poured in the sleeve 2 through the pouring opening 2A is forcibly injected into the mold cavity 8 formed between the molds 5 and 6. After the metal 7 solidifies in the mold cavity 8, the cast product is taken out from the mold cavity 8 upon moving the movable mold 6 apart from the stationary mold 5. Thereafter, the fins or flashes sticking to the plunger tip 1 are removed, and then the plunger tip 1 is driven in the opposite direction to the right in FIG. 1, and a lubricating agent such as graphite is applied to the desired surfaces such as those of the molds 5 and 6, the mold cavity 8, the pouring gate, the sprue runner and the inner surface of the sleeve 2 and the tip surface of the plunger tip 1 so as to be ready for the succeeding shot of die casting. This is one cycle of the shot of the die casting, and such a cycle is repeated so as to carry out the successive die casting operation.

In order to effect cooling of the plunger tip 1 and the spool bush 3, the plunger tip 1 and the spool bush 3 are provided with cooling passages 11 and 13, respectively, as shown in FIG. 1, so that cooling water is circulated therethrough via connecting passages llA, llB and 13A, 13B leading to the cooling water source (not shown) and the sump (not shown), respectively, in the conventional manner thereby preventing the temperature of these parts from being excessively raised.

In accordance with the present invention, one or more temperature sensers such as sheath-type thermocouples 21, 22, 23 in this embodiment are arranged in the plunger tip 1, the sleeve 2 and the spool bush 3, respectively, as shown. It must be understood, however, that it is not necessary to arrange the temperature sensers in all of the above described members, and that the temperature sensers may be arranged in an other suitable member than the above so as to measure the temperature at appropriate position for achieving the purpose of the present invention. In other words, the location and the number of the temperature sensers are not limited to the illustrated position and the number of the sensers as shown, but it suffices to arrange the senser(s) at position(s) thought to be appropriate for indicating representatively the course of the variation in the temperature of the member concerned in the die casting operation in order to ascertain the clearance between the inner surface of the sleeve 2 and the peripheral surface of the plunger tip 1 in each shot of die casting, and, hence, the time at which the plunger 1' is to be retracted after each shot.

Figure 2:
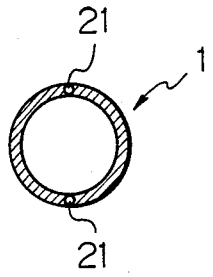
FIG. 2 is a cross-sectional view showing the transverse section of the plunger tip shown in FIG. 1.

Here, the plunger tip 1 is provided with a pair of sheath-type thermo-couples 21 located in a pair of elongated holes formed at positions diametrically opposite and extending in the axial direction of the plunger tip 1 with the tip of each thermo-couple 21 being located adjacent to the forward end of the plunger tip 1 as shown in FIG. 2, so that the temperature of the portion of the plunger tip 1 adjacent to the forward end can be measured. With respect to the sleeve 2 and the spool bush 3, the sheath-type thermocouples 22, 23 are arranged in the radial direction perpendicular to the axes of the sleeve 2 and the spool bush 3, respectively, so that the temperature of the portions adjacent to the inner surfaces of the sleeve 2 and the spool bush 3, respectively, can be measured.

Figure 3:
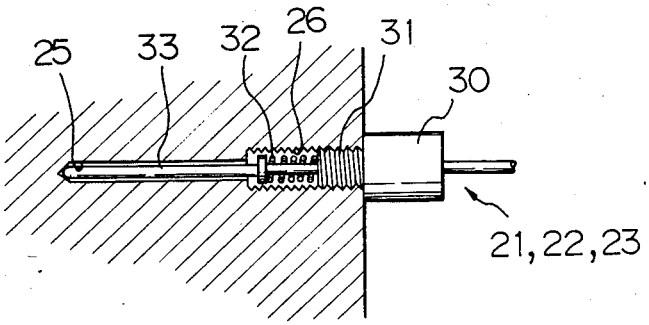
FIG. 3 is a sectional view in enlarged scale showing the mounting of the thermo-couple incorporated in the die casting apparatus of FIG. 1.

The mounting and fixing of each of the sheath-type thermo-couples 21, 22 or 23 in the respective members is preferably effected in such a manner as shown in FIG. 3. A receiving hole 25 formed with an internal thread 26 is provided in the member in which the thermo-couple 21, 22 or 23 is to be mounted, and the temperature sensing portion 33 thereof is inserted into the hole 25 and fixedly secured thereto by threadedly engaging the threaded portion 31 of the tightening knob 30 provided in the thermo-couple with the internal thread 26 of the hole 25 so that the forward end of the temperature sensing portion 33 positively abuts against the bottom of the hole 25 and is held in contact therewith by means of a compression spring 32 as shown. It is evident that any type of temperature sensers may be used in place of the above described sheath-type thermo-couple so long as the temperature senser makes it possible to detect the temperature of the portion at which the temperature senser is positioned.

Figure 4:
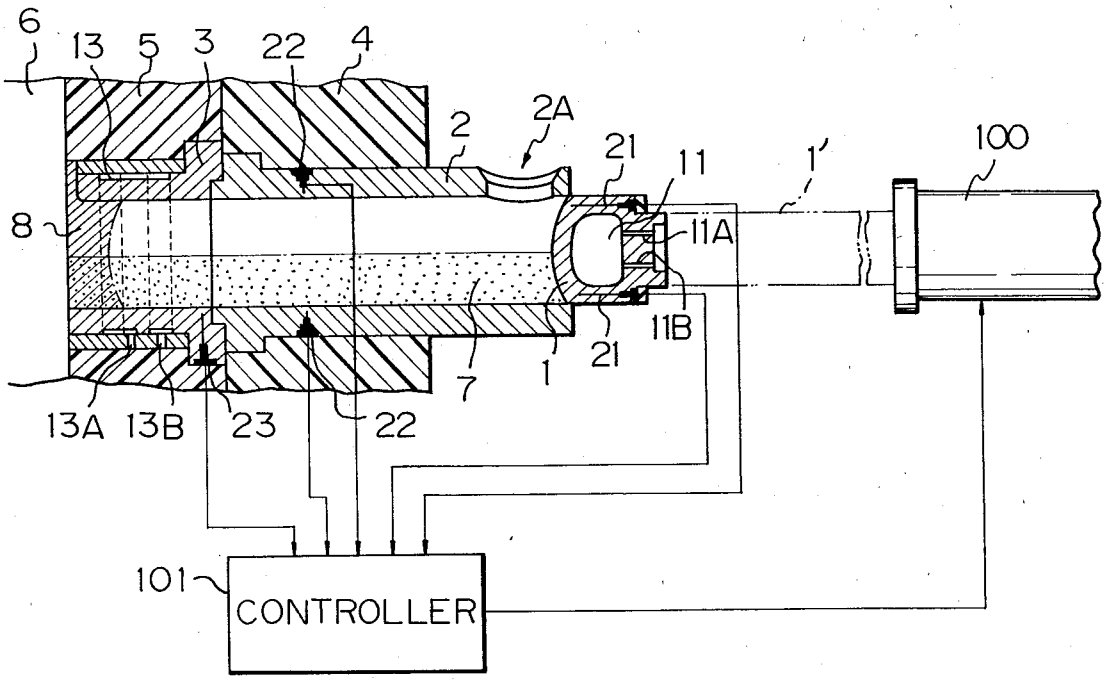
FIG. 4 is a schematic longitudinal sectional view similar to FIG. 1 but showing a circuit diagram of a controller for controlling the operation of the plunger tip according to the present invention.

The detected signals obtained by the temperature sensers (i.e., the sheath-type thermo-couples 21, 22, 23 in the illustrated case) are supplied to a controller 101 shown in FIG. 4 which incorporates therein a computer. The controller 101 monitors the received temperature signals measured by the temperature sensers 21, 22, 23 and carries out operations on the basis of these temperature signals so as to ascertain that the clearance between the inner surface of the sleeve 2 or the spool bush 3 and the peripheral surface of the plunger tip 1 after each shot of die casting is rendered to be sufficient for commencing retracting of the plunger 1' after each shot. At the appropriate time, the controller 101 actuates the pushing means 100 of the plunger 1' so as to retract the same.

After the cast product has been taken out from the mold cavity 8 upon moving the movable mold 6 apart from the stationary mold 5, the fins or flash around the plunger tip 1 are removed. The plunger tip 1 is retracted and lubricant is applied to the required portions of the die casting apparatus. The die casting apparatus is then readied for the succeeding die casting operation by moving the movable mold 6 toward the stationary mold 5 and holding the same in abutting relationship against the stationary mold 5.

It must be understood that the controller 101 may be made a separate device for monitoring the detected signals from the sheath-type thermo-couples 21, 22, 23 so as to ascertain that the clearance in question after each shot achieves the required value and, thereafter, issues the required output for controlling the operation of the plunger 1' after each shot. Alternatively, the controller 101 may be incorporated in the operation controlling system for entirely controlling the operation of the die casting apparatus.

Figure 5:
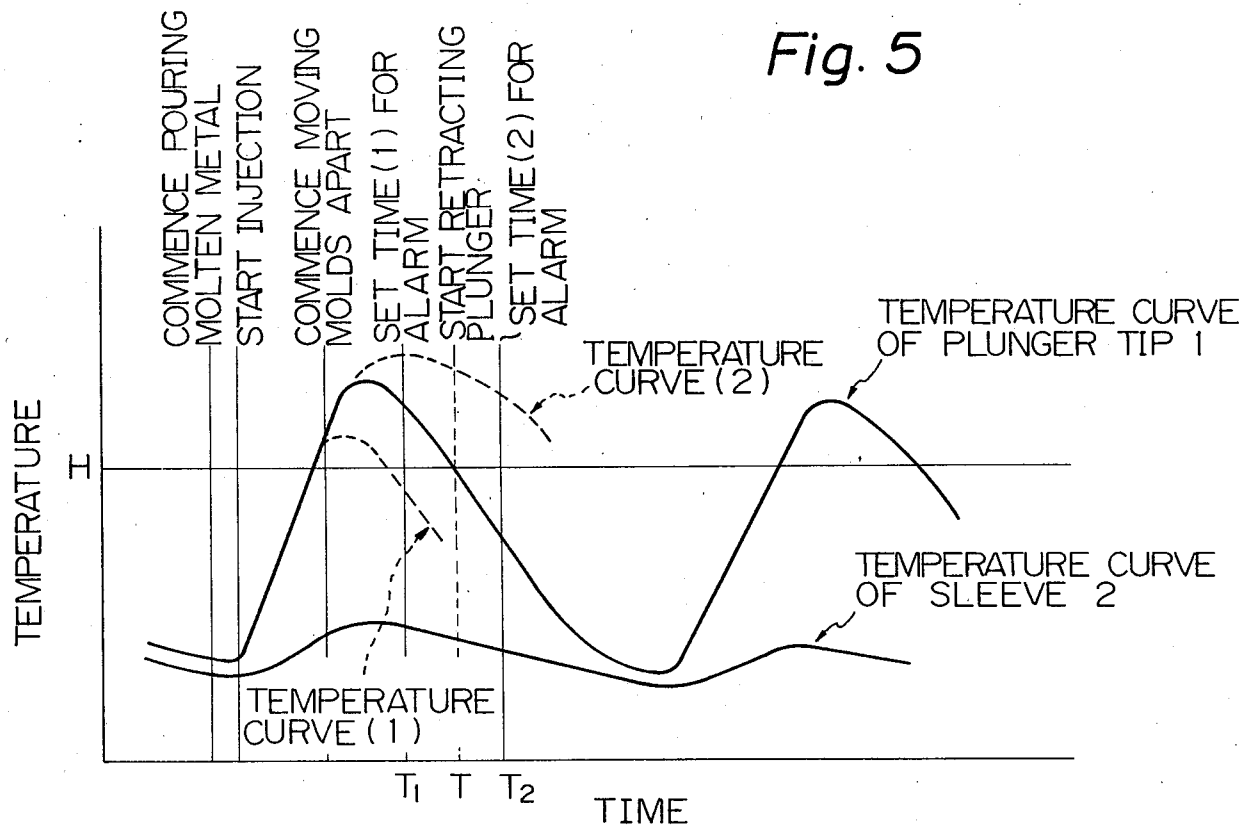
FIG. 5 is a diagram showing the relationship between the temperatures of the plunger tip and the sleeve and the lapse of time in each shot of die casting operation for controlling the operation in accordance with the present invention.

The above described calculation of the clearance in question obtained by the operation of the controller 101 on the basis of the measured temperatures after each shot (i.e., the determination of the time at which the plunger 1' is to be retracted after each shot of die casting) may be carried out in various ways. That is, if the temperatures of the plunger tip 1, the sleeve 2, and/or the spool bush 3 is measured, the clearance in question can be obtained by calculating the thermal expansion of the plunger tip 1, the sleeve 2, and/or the spool bush 3 resulting from the temperature thereof as measured by the thermo-couples 21, 22 and 23. When the thus obtained clearance reaches a predetermined value, the time at which the thus obtained clearance has reached a set value after each shot is assumed as the time at which the plunger is to be retracted after each shot. Alternatively, since the plunger tip 1, the sleeve 2, and the spool bush 3 are in thermally related relationship to each other, it is possible to calculate the clearance in question with a sufficient accuracy by monitoring any one of the temperatures of the plunger tip 1, the sleeve 2, and the spool bush 3 as measured by the temperature sensers 21, 22 and 23. Therefore, it is possible, for example, to calculate the time T (shown in FIG. 5) as a time at which the plunger 1' is to be retracted after each shot by measuring only the temperature of the plunger tip 1 by the temperature senser 21 and monitoring the temperature of the plunger tip 1 after each shot so as to detect the time T at which the temperature thus measured reaches the set temperature H. It is evident that the operational equations for assuming the clearance in question on the basis of the measured temperature(s) in any one of the plunger tip 1, the sleeve 2, and the spool bush 3 or the combination thereof may be made arbitrary insofar as they are appropriate for achieving the purpose of the present invention. Similarly, it is possible to adopt various other measures by previously determining empirically the corelationship between the temperature(s) measured at any of the members or any combination thereof and the clearance in question so as to ascertain the required time at which the plunger 1' is to be retracted after each shot of die casting.

With the method of die casting in accordance with the present invention described above, the clearance between the inner surface of the sleeve 2 and/or the spool bush 3 and the plunger tip 1 can be calculated by the measurement of the temperature of at least one appropriate portion such as in the plunger tip 1, the sleeve 2 and the spool bush 3 so as to determine the time at which the plunger 1' is to be retracted after each shot. In other words, since the achievement by the clearance in question of a set value (and, hence, the time at which the plunger 1' is to be retracted after each shot) is determined on the basis of the detection of the temperature or the relationship between the temperatures of the members directly concerned to the variation in clearance in question during the die casting, the time at which the plunger 1' is to be retracted after each shot may be positively, rapidly, and effectively determined without fail.

Now a further characteristic feature of the present invention will be described below. It can generally be said that the course of variation in the temperatures of the plunger tip 1 and the sleeve 2 as the time lapses, for example, will take place as shown by solid lines in FIG. 5, although some deviation or fluctuation will occur. To the contrary, in an abnormal condition such as in the case the supply of the cooling water into the plunger tip 1 is interrupted, the temperature rise in the plunger tip 1 is serious and the temperature drop of the plunger tip 1 is rendered to be extremely delayed as shown by temperature curve (2) in FIG. 5. In such a case, the biting of the casting fins or flashes in the clearance caused by the retracting of the plunger tip 1 which results in the failure of or damage to either the plunger tip 1 or the sleeve 2 can be avoided, because the plunger 1' is withheld from being retracted by virtue of the operation of the controller 101 until the predetermined set clearance is reached. However, since such a condition is in any event an abnormal condition and must be rapidly remedied or repaired, it is preferred to detect such a condition and generate a warning to inform the operator of the abnormal condition. To this end, in the present invention, a predetermined time $T_2$ as measured from the time of commencement of injection of the molten metal is set in the controller 101 which is thought to be sufficient so as to permit the temperature of the plunger tip 1 to reach a set temperature H. When the temperature of the plunger tip 1 reaches the set temperature H prior to the lapse of the set time $T_2$, the plunger 1' is retracted after each shot or commencement of movement of the movable mold 6, whereas the plunger 1' is withheld from being retracted after each shot or commencement of movement of the movable mold 6 and an alarm is actuated for indicating occurrence of failure when the temperature of the plunger tip 1 measured by the temperature senser 21 does not drop to the set temperature H after the lapse of the set time $T_2$ after each shot or commencement of movement of the movable mold 6. In this event, is assumed that an abnormal condition has taken place, such as failure in supplying the cooling water, failure of the temperature senser, or breakage of the lead wires of the senser.

On the other hand, it has been found to be preferred in actual practice for expediting the repairing operation that the retracting of the plunger 1' is not withheld when the set time $T_2$ is reached. Instead, the plunger 1' is forcibly retracted while an alarm is simultaneously actuated so that the operator is informed of the occurrence of possible failure of the plunger tip 1 or the sleeve 2 due to the forcible retracting of the plunger 1'. The alarm alerts the operator be ready for quick repairing operation or maintenance.

Further, a possibility exists that the temperature drop of the plunger tip 1 will take place far more quickly than in the normal operation as indicated by the temperature curve (1), wherein the temperature of the plunger tip 1 descends below the set temperature H before another set time $T_1$ as measured from the time of commencement of injection of the molten metal. The set time $T_1$ is thought to be required for carrying out the usual operation for removing fins or flashes sticking to the plunger tip 1 upon removal of the die cast product after the movable mold 6 is moved apart from the stationary mold 5. In such a case, if the plunger 1' is retracted as soon as the set temperature H is detected, the plunger 1' will not have remained in position a sufficient time to effect proper operation of the die casting apparatus. In order to avoid such a difficulty, the plunger tip 1 is not retracted even though the temperature of the plunger tip 1 descends below the set temperature H before the set time $T_1$ is reached, and the plunger 1' is not retracted until after the set time $T_1$ is reached.

As described above, the method of die casting of the present invention can detect the occurrence of an abnormal condition in a very simple manner so as to positively avoid troubles due to possible occurrence of the abnormal condition.

The present invention has been described with reference to an embodiment illustrated in the accompanying drawings. However, it will be understood by a person skilled in the art that the detecting signals may be either of the types of analog processing or digital processing, and various abnormal conditions may be detected in any combination thereof. All such modifications are within the scope of the present invention and may be readily put into practice by a person skilled in the art.

What is claimed is:

1. Method of die casting including forcibly injecting a predetermined amount of molten metal supplied to the inner space of a sleeve into a mold cavity through a spool bush connected between said sleeve and said mold cavity by means of a plunger tip secured to a plunger reciprocally driven in said sleeve so as to produce a die cast product in said mold cavity, characterized by measuring the temperature of at least a portion of at least one of said plunger tip, said sleeve, and said spool bush to thereby control the time of commencement of retraction of said plunger on the basis of the measured temperature after each shot of die casting.

2. Method of die casting according to claim 1, characterized by measuring the temperature of said plunger tip and commencing retracting of said plunger at the time the temperature of said plunger tip drops to a predetermined set temperature.

3. Method of die casting according to claim 1, characterized by measuring the temperature of said plunger tip, said sleeve, and/or said spool bush, calculating the clearance at the peripheral surface of said plunger tip on the basis of the measured temperatures, and commencing retracting of said plunger at the time said calculated clearance is calculated to reach a predetermined set value of clearance.

4. Method of die casting according to claim 1, characterized by delaying retracting of said plunger until a set time measured from commencement of injecting the molten metal has been reached, said set time being set so as to insure sufficient time for removing the fins or flashes around the plunger tip after each shot.

5. Method of die casting according to claim 1, characterized by actuation of an alarm when the temperature of said plunger tip does not reach a set temperature, at the time another set time is reached to thereby permit expediting the repairing of the abnormal conditions.

6. A method of determining the presence of an abnormal operating condition taking place during the sequential molding of a plurality of metal castings in a molding machine in which molten metal is forcibly injected into a mold cavity through a sleeve and a spool bush by means of a plunger tip secured to a plunger which is reciprocally driven in the sleeve, said method comprising the steps of:

(a) continuously measuring the temperature of at least one portion of the molding machine during the molding operation and (b) calculating the clearance between the sleeve and the plunger tip based on the temperature of said at least one portion of the molding machine.

7. A method as recited in claim 6 wherein said at least one portion of the molding machine is a portion of the plunger tip.

8. A method as recited in claim 6 wherein said at least one portion of the molding machine is a portion of the sleeve.

9. A method as recited in claim 6 wherein said at least one portion of the molding machine is a portion of the spool bush.

10. A method of controlling the time of the commencement of the withdrawal of the plunger in a molding machine in which molten metal is forcibly injected into a mold cavity through a sleeve and a spool bush by means of a plunger tip secured to the plunger in response to the detection of an abnormal operating condition taking place during sequential molding of a plurality of metal castings, said method comprising the steps of:

(a) continuously measuring the temperature of at least one portion of the molding machine during the molding operation;

(b) normally commencing the withdrawal of the plunger when said at least one portion of the molding machine falls to a predetermined temperature;

(c) commencing the withdrawal of the plunger at a first predetermined interval after the completion of the loading stroke even if said at least one portion of the molding machine has not yet fallen to said predetermined temperature; and (d) delaying the withdrawal of the plunger until after the elapse of a second predetermined interval after the completion of the loading stroke even if said at least one portion of the molding machine has fallen to said predetermined temperature before the elapse of said second predetermined interval.

11. A method as recited in claim 10 wherein said at least one portion of the molding machine is a portion of the plunger tip.

12. A method as recited in claim 10 wherein said at least one portion of the molding machine is a portion of the sleeve.

13. A method as recited in claim 10 wherein said at least one portion of the molding machine is a portion of the spool bush.

14. A method as recited in claim 10 and further comprising the step of actuating an alarm if said at least one portion of the molding machine has not yet fallen to said predetermined temperature by the elapse of said first predetermined interval.

15. A method as recited in claim 10 and further comprising the step of actuating an alarm if said at least one portion of the molding machine has fallen to said predetermined temperature before the elapse of said second predetermined interval.

* * * * *